US010746431B2

(12) United States Patent
Yang et al.

(10) Patent No.: US 10,746,431 B2
(45) Date of Patent: Aug. 18, 2020

(54) AIR VENT STRUCTURE AND BOX-TYPE INVERTER HAVING THE SAME

(71) Applicant: Sungrow Power Supply Co., Ltd., Hefei, Anhui (CN)

(72) Inventors: Ye Yang, Anhui (CN); Guoqi Zhang, Anhui (CN); Jie Zhou, Anhui (CN)

(73) Assignee: Sungrow Power Supply Co. Ltd. (CN)

( * ) Notice: Subject to any disclaimer, the term of this patent is extended or adjusted under 35 U.S.C. 154(b) by 102 days.

(21) Appl. No.: 15/979,149

(22) Filed: May 14, 2018

(65) Prior Publication Data

US 2018/0356121 A1 Dec. 13, 2018

(30) Foreign Application Priority Data

Jun. 12, 2017 (CN) ..... 2017 2 0676509 U

(51) Int. Cl.
*F24F 13/08* (2006.01)
*F24F 13/28* (2006.01)
*F24F 13/20* (2006.01)

(52) U.S. Cl.
CPC ..... *F24F 13/085* (2013.01); *F24F 13/20* (2013.01); *F24F 13/28* (2013.01); *F24F 2013/088* (2013.01); *F24F 2221/52* (2013.01)

(58) Field of Classification Search
CPC ..... F24F 13/085; F24F 13/20; F24F 13/28; F24F 2013/088; F24F 2221/52
USPC ..... 454/275, 367
See application file for complete search history.

(56) References Cited

U.S. PATENT DOCUMENTS 345,689 A * 7/1886 Hayes ..... E06B 9/52 454/275
1,657,625 A * 1/1928 Hoal ..... F24F 13/08 D25/48.1
4,103,468 A * 8/1978 Olsen ..... F24F 13/08 52/473
5,254,034 A * 10/1993 Roth ..... F24F 13/08 454/277

(Continued)

FOREIGN PATENT DOCUMENTS

CN 202260976 U 5/2012
JP 062776 U 1/1994

OTHER PUBLICATIONS

First Examination Report dated Apr. 30, 2020, received for Indian Patent Application No. 201814016465.

*Primary Examiner* — Edelmira Bosques
*Assistant Examiner* — Dana K Tighe
(74) *Attorney, Agent, or Firm* — Conley Rose, P.C.

(57) ABSTRACT

An air vent structure includes a frame arranged at an air outlet or an air inlet of a box body, and a plurality of plates. In cross section, each of the plates is a bent structure and includes a first flat portion, an upslope portion and a downslope portion. The first flat portion is fixed to the frame and extends in a direction away from the frame, the plate then extending upward to form the upslope portion. A top of the upslope bends downward to form the downslope portion, and the height of the downslope portion is smaller than the height of the upslope portion. The air vent structure can ensure that hot air flow passes smoothly through the air outlet, and also ensure that the hot air flow is blown out in a horizontal direction. A box-type inverter having the air vent structure is also provided.

14 Claims, 9 Drawing Sheets

(56) References Cited

U.S. PATENT DOCUMENTS

| | | | | |
|---|---|---|---|---|
| 6,138,424 | A * | 10/2000 | Akerson | F24F 13/082 454/279 |
| 2001/0024942 | A1* | 9/2001 | Darcey | F24F 13/082 454/367 |
| 2003/0050006 | A1* | 3/2003 | Myint | E03B 11/08 454/281 |
| 2016/0043611 | A1* | 2/2016 | Ikeda | F02B 63/044 290/1 A |

* cited by examiner

AIR VENT STRUCTURE AND BOX-TYPE INVERTER HAVING THE SAME

CROSS REFERENCE TO RELATED APPLICATION

The present application claims the benefit of priority to Chinese Patent Application No. 201720676509.7 titled "AIR VENT STRUCTURE AND BOX-TYPE INVERTER HAVING THE SAME", filed with the Chinese State Intellectual Property Office on Jun. 12, 2017, the entire disclosure of which is incorporated herein by reference.

FIELD

The present application relates to an air vent structure, and particularly relates to an air vent structure and a box-type inverter having the air vent structure.

BACKGROUND

Box-type inverters are increasingly used in harsh environments like deserts and mountain areas with sandstorm, blizzard and the like. As shown in FIG. 1, a conventional air outlet 1 (which may also be an air inlet), is designed to face downwards for resisting water, and in this way, rainwater or accumulated snow is prevented from entering an air duct to a certain extent. In addition, in order to prevent dust from entering an interior of a box body, the air outlet 1 is provided with a dust filter 2, which can prevent dust from entering the interior of the box body as might occur during a sandstorm.

The structure of this air outlet of the conventional inverter has advantages, but also has disadvantages which are reflected in that:

1. The structure of the downward air outlet 1 direct hot air of the air outlet 1 downward, and if an air inlet is close to the air outlet, the hot air may be sucked into the air inlet, thus adversely affecting the heat dissipation performance of the entire inverter;

2. The air outlet 1 is provided with the dust filter 2 for resisting dust, which may increase the system resistance, reduce an air volume of a fan, and thus significantly affects the heat dissipation performance of the inverter, which could result in a too high temperature of a module, such that the heat dissipation requirements cannot be met.

For an air outlet of FIG. 2, water can easily enter an air duct or the inverter during a waterproof test when a water jet impacts upward at a certain angle from a lower position. Thus, this type of air outlet has a lower waterproof level and is poorly suited for an application requiring a high degree of waterproofness. To prevent such a water jet from entering an interior of the air duct, a non-planar or bent structure of this type of air outlet of FIG. 2 should be made to be very dense, which may greatly increase the air flow resistance, and the air flow out of the inverter is not smooth when entering this air outlet, thus the resistance is also increased. Even for an air outlet having a self-hanging louver structure, as shown in FIG. 3, the waterproof level is relatively low, and rain and snow may also enter the interior of the air duct. An external air vent structure is not conducive to installation and transportation, and long-term jolts may lead to looseness of screws.

SUMMARY

In order to improve the ability to resist water and snow intrusion, an air vent structure and a box-type inverter having the air vent structure are provided according to the present application.

In a solution according to the present application: an air vent structure, including a frame arranged at an air outlet or an air inlet of a box body of a box-type inverter; wherein the air vent structure further includes multiple plates arranged perpendicular to a direction of gravity and parallel to each other, and a cross section of each of the plates is a bent structure, each of the plates comprises a first flat portion, an upslope portion and a downslope portion, and wherein the first flat portion of each of the plates is fixed to the frame and extends in a direction away from the frame, the plate then extending upward to form the upslope portion, and wherein a top of the upslope bends downward to form the downslope portion, and wherein the height of the downslope portion is smaller than the height of the upslope portion.

In some embodiments, each of the plates further includes a second flat portion between the upslope portion and parallel to the first flat portion.

Further, the plates may further comprise a third flat portion parallel to the first flat portion and connected to the downslope portion.

In some embodiments the air vent structure includes a pair of adjacent plates, wherein the perpendicular distance between the second flat portion of the lower plate and the first flat portion of the upper plate is smaller than the perpendicular distance between the third flat portion and the first flat portion of a same plate of the pair.

Further, in some embodiments, the perpendicular distance between the two plates of the pair is larger than the perpendicular distance between the third flat portion and the first flat portion of each of the plates.

As a further improvement of the above solution, in some embodiments, each of the plates is an integrally molded structure.

Further, each of the plates may be formed by bent a stamping part.

In some embodiments, one side of the air vent structure is mounted with a self-hanging louver through a linkage.

In some embodiments, one side of the air vent structure is mounted with a screen mesh.

In some embodiments, a box-type inverter is further provided according to the present application, and the air inlet or the air outlet of the box-type inverter is mounted with the air vent structure according to any one of above descriptions.

Beneficial effects of the certain of the embodiments described herein include that: this type of air vent structure can fully meet the IP65 waterproof level requirements, effectively prevent rain and snow from entering an interior of an air duct, and in a case that a small amount of rainwater enters the air duct, the rainwater can also flow out of a wall of a box through gaps at the air vent; trapezoidal plates and a self-hanging louver structure can prevent dust, wind-blown sand and the like from flowing backward into an interior of the louver; the air vent structure can ensure that hot air flow passes smoothly through an air outlet, and that the hot air flow is blown out in a horizontal direction, which basically does not affect air flow at an air inlet, and backflow of the hot air is avoided, thus improving a heat dissipation effect; the air vent structure in the present application can be installed inside a factory without the requirement of field installation and assembly, which has a controllable installation quality and does not affect the transportation.

DETAILED DESCRIPTION OF EXEMPLARY EMBODIMENTS

The present application will be further described in detail hereinafter in conjunction with the accompany drawings and exemplary embodiments, so that purposes, technical solutions and advantages of the present application can be more obvious and understandable. It should be understood that, the exemplary embodiments hereinafter are only used to illustrate the present application rather than limit the present application.

First Embodiment

Figure 4:
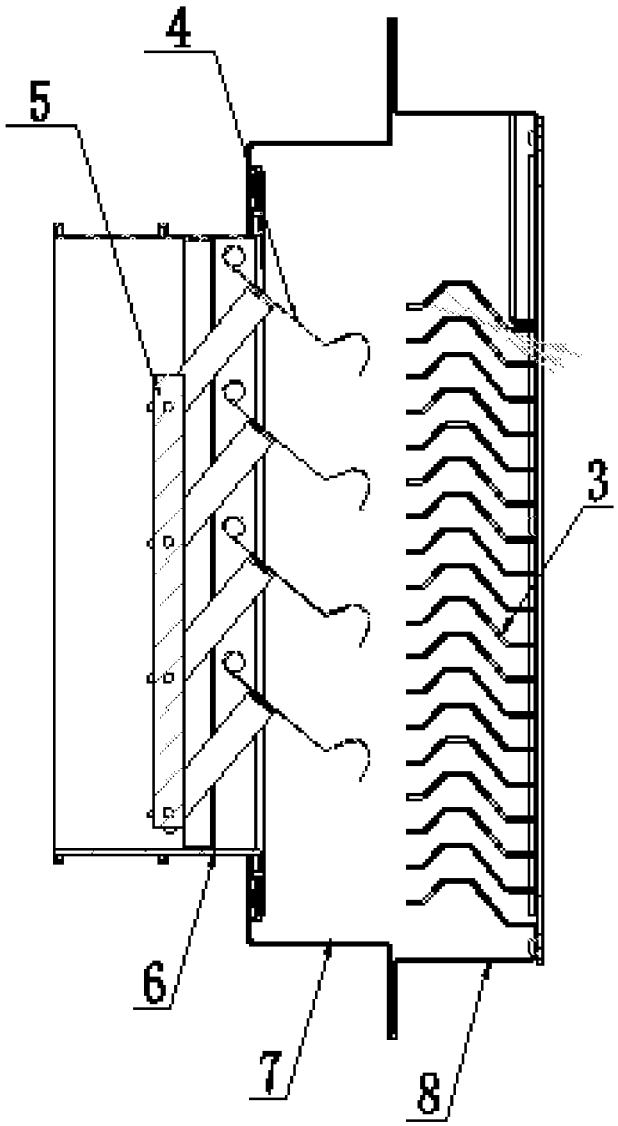
FIG. 4 is a schematic, cross sectional, view showing an air vent structure according to a first embodiment of the present application.
Figure 5:
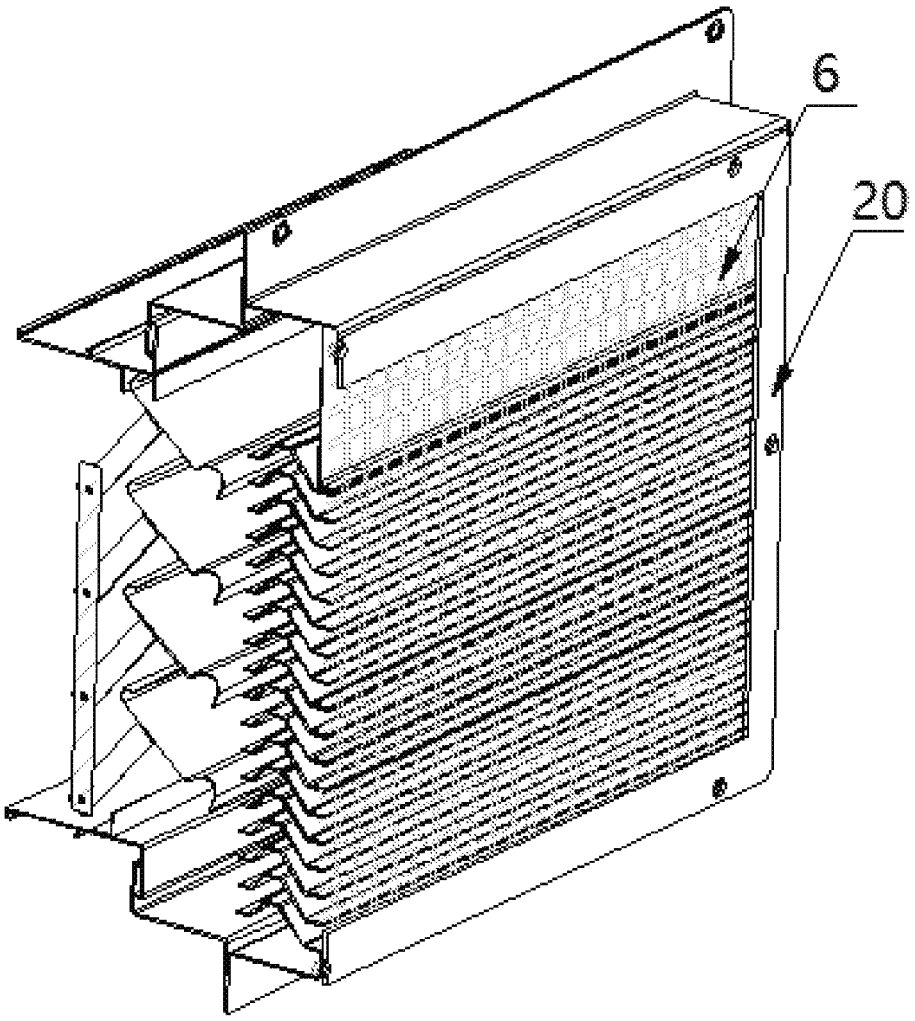
FIG. 5 is a perspective view of the air vent structure in FIG. 4.

Referring first to FIGS. 4 and 5 together, an air vent structure in this embodiment includes a frame 20, multiple plates 3, a self-hanging louver 4, a linkage 5 and a screen mesh 6. The frame 20 is mounted at an air vent of a box body (not shown in FIGS. 4 and 5), and the air vent may be an air outlet or an air inlet. In the present embodiment, the air outlet is described in detail as an example. The frame 20 may be formed by surrounding multiple air duct face plates 8, the multiple plates 3 are arranged perpendicular to the direction of gravity and parallel to each other, and one side of the air vent structure is mounted with one self-hanging louver 4 through the linkage 5. Wind (i.e. moving air) blows from a left side of the air vent in FIG. 4 and blows the self-hanging louver 4 open, then enters the air outlet, and then blows into the external environment. The screen mesh 6 is mounted at one side of the air vent structure, and of course, another screen mesh 6 (not shown) may be provided at another opposite side of the air vent structure.

As viewed in cross section, each of the plates 3 is an angled or bent structure, and each of the plates 3 preferably employs an integrally molded structure, for example, a stamping part that is bent to form the integrally molded structure.

Figure 6:
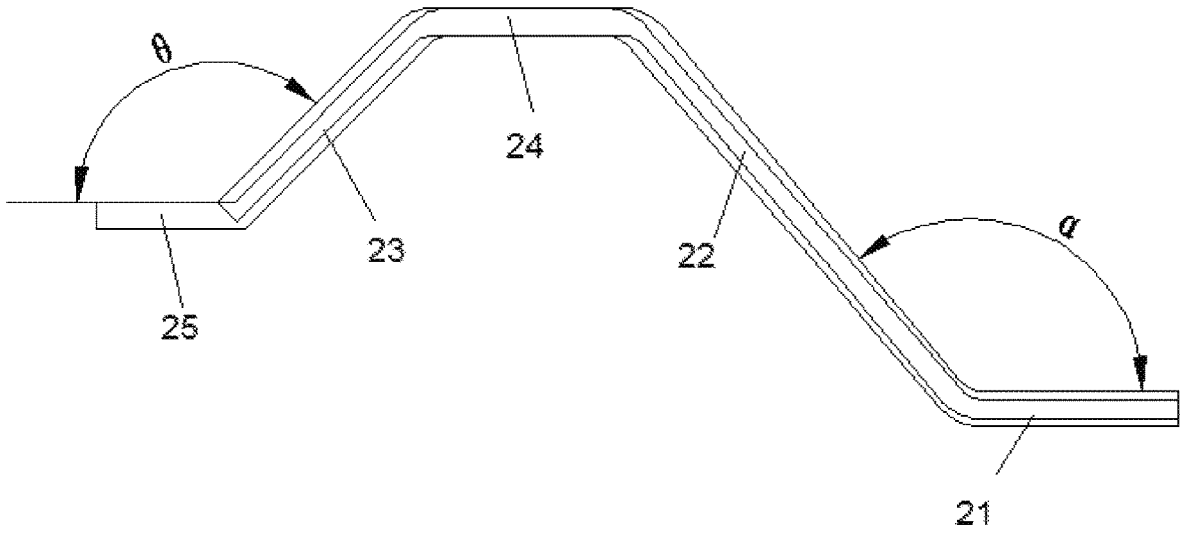
FIG. 6 is a schematic view showing a plate of the air vent structure shown in FIGS. 4 and 5.
Figure 7:
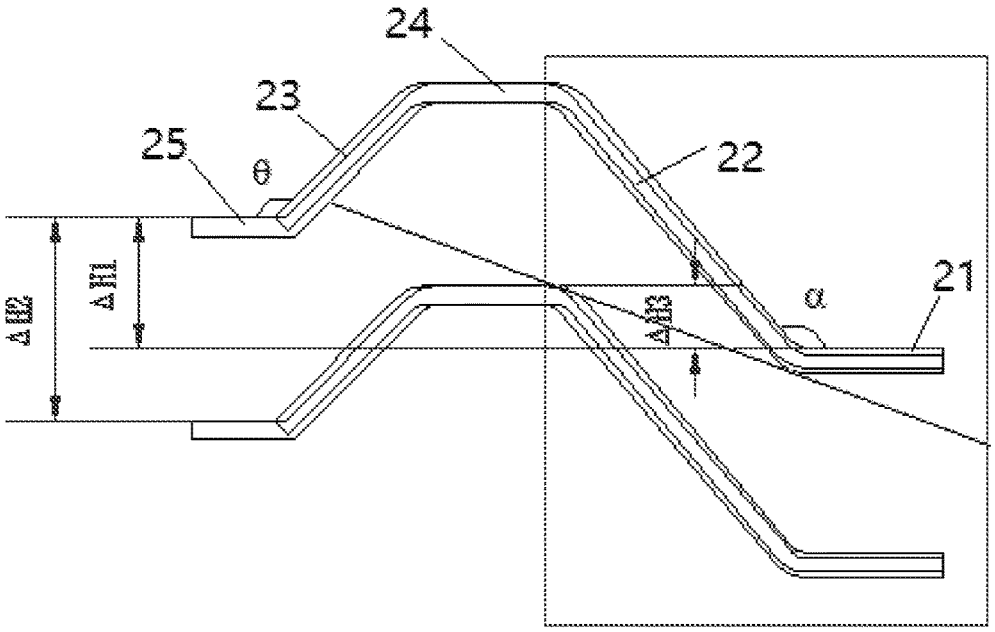
FIG. 7 is a schematic view showing a layout of two adjacent plates of the air vent structure shown in FIGS. 4 and 5.

Referring to FIGS. 6 and 7, in this embodiment, each of the plates 3 includes a first flat portion 21, an upslope portion 22, a downslope portion 23, a second flat portion 24 and a third flat portion 25. Two ends of first flat portion 21 of each of the plates 3 are fixed to two opposite sides of the frame 20. First flat portion 21 of each of the plates 3 extends perpendicularly in a direction away from the frame 20. Each plate 3 then extends upward from first flat portion 21 to form the upslope portion 22 having a slope angle $\alpha$. A top of the upslope portion 22 may extend perpendicularly in the direction away from the frame 20 to form the second flat portion 24 that is parallel with first flat portion 21. As such, the second flat portion 24 is connected between the upslope portion 22 and the downslope portion 23. The downslope portion 23 extends downwardly from second flat portion 24 and away from the frame 20 where it joins the third flat portion 25 that is parallel to the first flat portion 21. The slope angle $\theta$ between downslope portion 23 and third flat portion 25 is an obtuse angle. A horizontal structure of the third flat portion 25 can have a flow-guiding function, so that the wind from the inverter can smoothly enter between the plates 3 through the self-hanging louver 4, and air resistance is reduced. The slope angle $\alpha$ is also an obtuse angle, and a horizontal structure of the first flat portion 21 ensures that a wind direction is horizontal when the air vent structure blows the air outward, which may prevent backflow of hot air.

Referring to FIG. 7 again, a height of the downslope portion 23 is smaller than a height of the upslope portion 22, and the height of the downslope portion 23 is preferably half of the height of the upslope portion 22. In the pair of two adjacent plates 3 shown in FIG. 7, a perpendicular distance between the second flat portion 24 of the lower plate 3 and the first flat portion 21 of the upper plate 3 is smaller than a perpendicular distance between the third flat portion 25 and the first flat portion 21 of the same plate 3. A perpendicular distance between two adjacent plates 3 is larger than the perpendicular distance between the third flat portion 25 and the first flat portion 21 of each of the plates.

Figure 1:
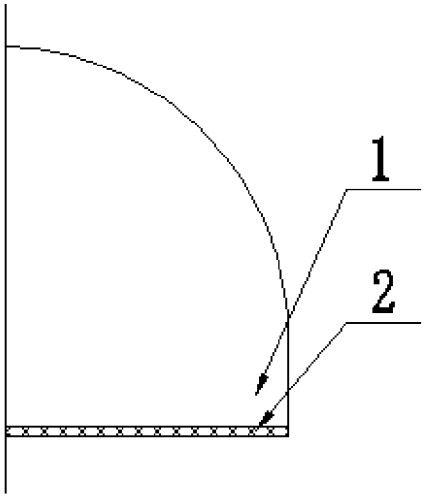
FIG. 1 is a cross sectional view showing an air outlet of a first conventional inverter.
Figure 2:
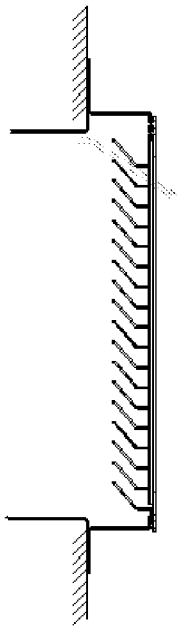
FIG. 2 is a cross sectional view showing an air outlet of a second conventional inverter.
Figure 3:
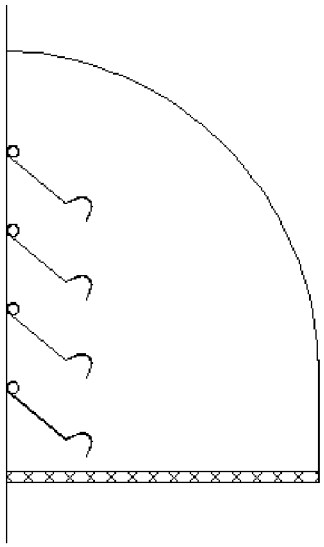
FIG. 3 is cross sectional view showing an air outlet of a third conventional inverter.
Figure 8:
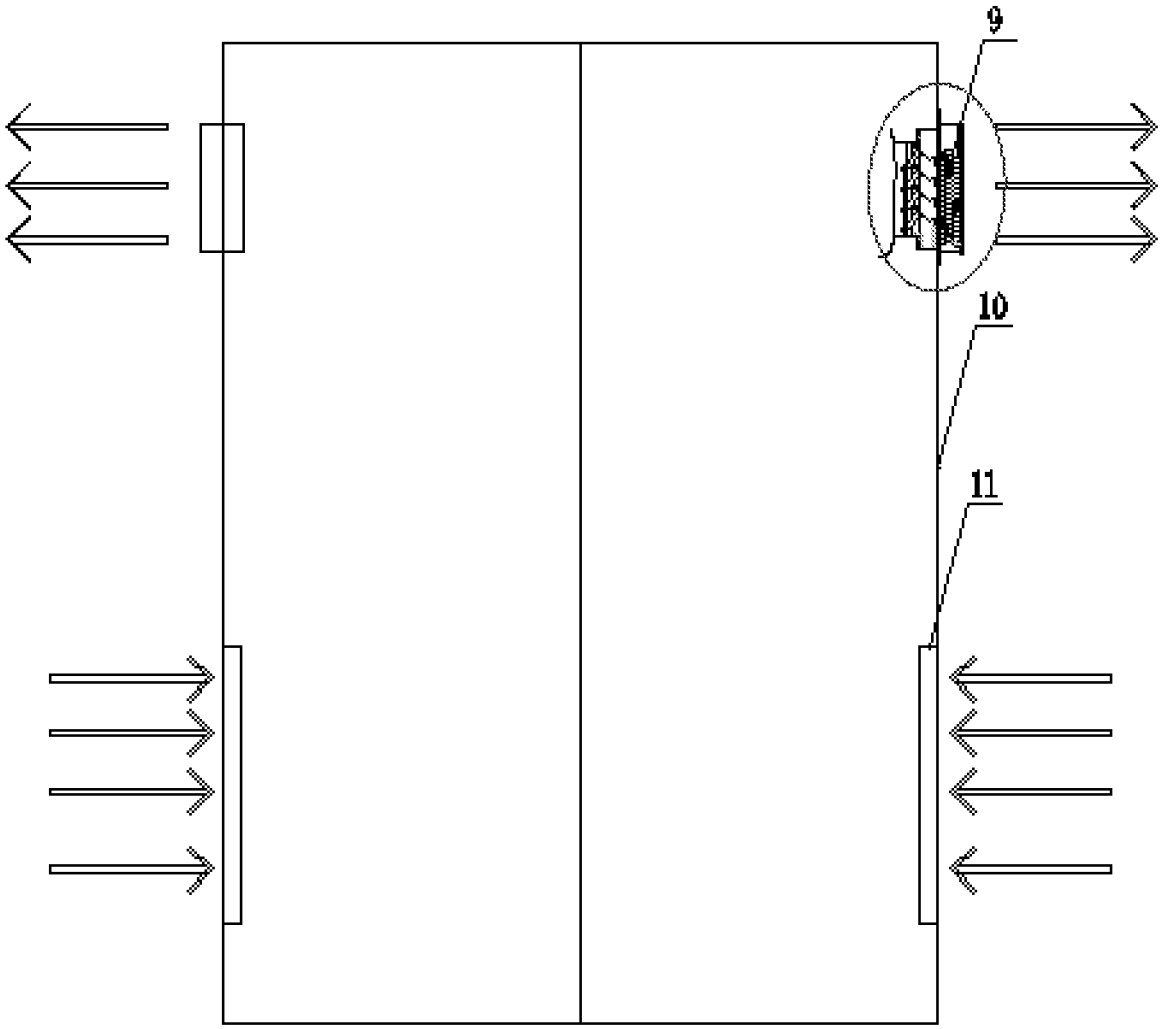
FIG. 8 is a schematic view showing a structure of a box-type inverter employing the air vent structure in FIGS. 4 and 5.

Referring still to FIG. 7, the third flat portion 25 is $\Delta H1$ (that is the perpendicular distance between the third flat portion 25 and the first flat portion 21 of the same plate 3) higher than the first flat portion 21, the second flat portion 24 is $\Delta H3$ (that is the perpendicular distance between the second flat portion 24 of the plate 3 at the lower side and the first flat portion 21 of the plate 3 at the upper side in two adjacent plates 3). Providing these two height differences can provide a waterproof function. When the water jet is jetted toward the interior of the air duct from all directions of the outside, most of the water jet will be in a rectangular frame area shown in FIG. 7, and the water jet will be blocked by the second flat portion 24 and the upslope portion 22 and may not enter the interior of the air duct. Even though a small amount of water enters the interior of the air vent when being jetted at a certain angle, the water will be blocked by the downslope portion 23 (as shown by a long oblique line in FIG. 7). Such blocked water falls onto the third flat portion 25 and vertically flows to a bottom of the air vent structure. A small hole is provided at the bottom of the air vent structure, and referring to FIG. 8, the water flow will flow along the wall surface 10 to the outside of the box body, which is not like the water being directly jetted into the air duct in the air outlet in FIG. 2. Such an integral structure effectively improves the level or degree of waterproofness of the air vent. In FIG. 8, the air inlet 11 of the box-type inverter is arranged at an end, close to the ground, of each side wall of the box body, and the air outlet of the box-type inverter is arranged at an end, away from the ground, of each side wall of the box body. The installation of the air vent structure 9 according to the present application can ensure a certain distance ΔH2 between each adjacent two bent parts, therefore the bent part are not too dense, and thus the overall wind resistance may not increase too much.

In conclusion, the present application provides a structural form having a high protection level, including the self-hanging louver 4, the trapezoidal plates 3, the screen mesh 6, the air vent face plates 8 at different positions and the like.

Second Embodiment

Figure 9:
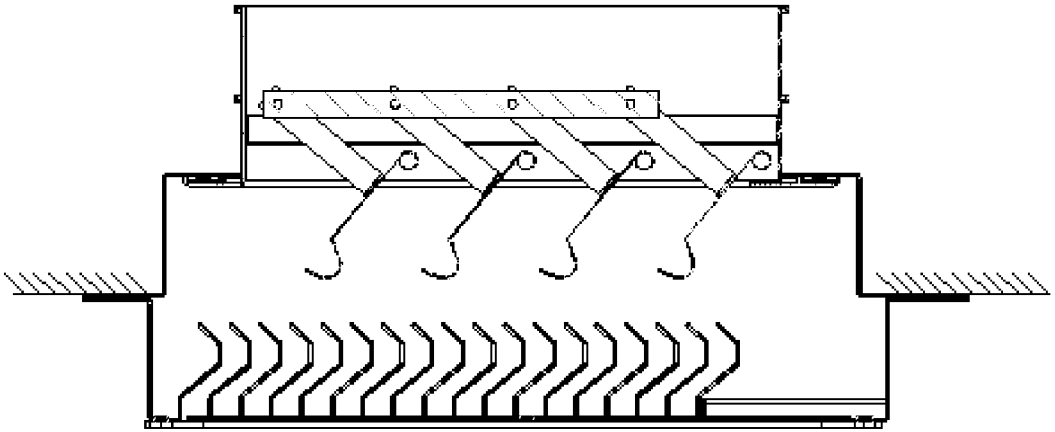
FIG. 9, similar to FIG. 4, is a side view showing an air vent structure according to a second embodiment of the present application.

Referring to FIG. 9, a second embodiment is shown to be similar to the first embodiment. In this embodiment, each plate 3 includes first and second flat portions 21, 24 and includes upslope portion 22 and downslope portion 23 all as described above with respect to FIGS. 6 and 7. However, in this embodiment, third flat portion 25 is not included in plate 3. Nevertheless, a water jet will be blocked by the second flat portion 24 and the upslope portion 22 and the downslope portion 23, and water therefore may not enter the interior of the air duct.

Third Embodiment

Figure 10:
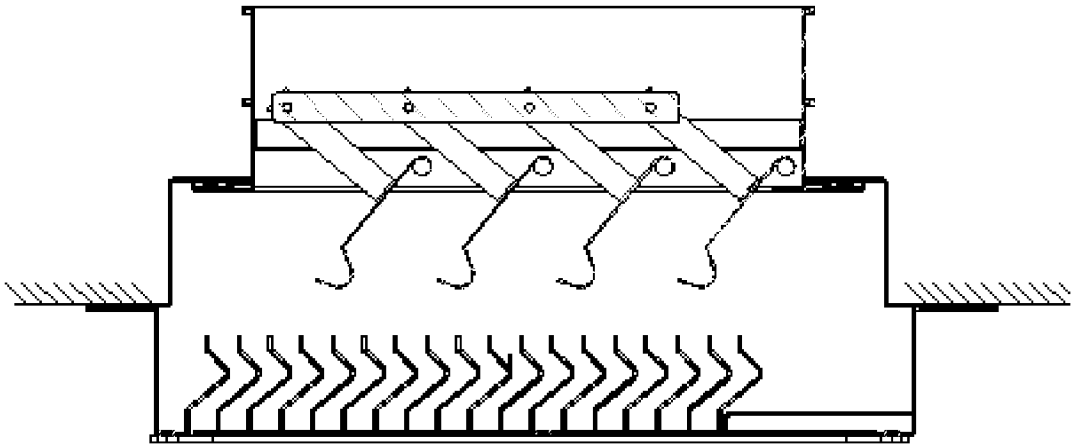
FIG. 10, similar to FIGS. 4 and 9, is a side view showing an air vent structure according to a third embodiment of the present application.

Referring now to FIG. 10, a third embodiment is shown to be similar to the first embodiment. In this embodiment, each plate 3 includes first and third flat portions 21, 25 and includes upslope portion 22 and downslope portion 23 all as described above with respect to FIGS. 6 and 7. However, in this embodiment, second portion 25 is not included in plate 3. Instead, from the top of the upslope portion 22, plate 3 bends directly downward to form the downslope portion 23 having a slope angle θ measure relative to the horizontal (as shown in FIG. 7). Nevertheless, a water jet will be blocked by the upslope portion 22 and the downslope portion 23, and water therefore may not enter the interior of the air duct.

Fourth Embodiment

Figure 11:
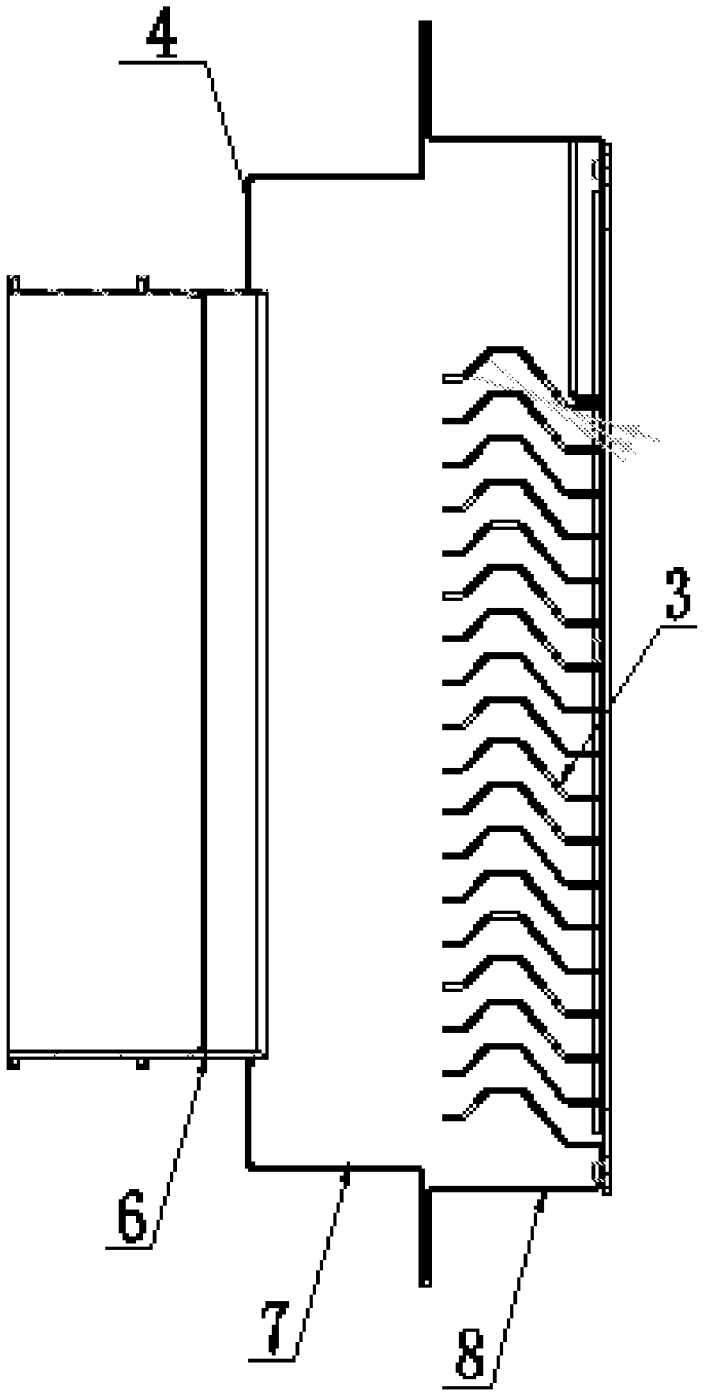
FIG. 11 is a schematic, cross sectional view showing a structure of the air vent structure according to the fourth embodiment of the present application.

Referring to FIG. 11, the difference between an air vent structure in the fourth embodiment and the air vent structure in the first three embodiments lies in that, the air vent structure in the first three embodiments is used as the air outlet, and the air vent structure in the fourth embodiment shown in FIG. 11 is used as the air inlet. In the case that the air vent structure is used as the air inlet as in FIG. 11, the self-hanging louver is not required, and wind enters from a right side in FIG. 11, and enters inside the box body through the air vent structure.

The air vent structure in the fourth embodiment can fully meet the IP65 waterproof level requirements, and effectively prevent rain and snow from entering the interior of the air duct, and the rainwater can also flow out of a wall of a box through gaps at the air vent in a case that a small amount of rainwater enters the air duct. Trapezoidal plates can prevent dust, wind-blown sand and the like from flowing backward into the interior of the box body. The air vent structure can ensure that hot air flow passes smoothly through the air outlet, and also can ensure that the hot air flow is blown out in a horizontal direction, which basically does not affect air flow at the air inlet, and backflow of the hot air is avoided, thus improving a heat dissipation effect. The air vent structure according to the present application can be installed in the initial manufacturing process, and thus would not require field installation and assembly. This provides a controllable installation quality and does not affect the transportation.

The embodiments described hereinabove are only preferred embodiments of the present application, and should not be interpreted as limitation to the protection scope of the present application. Any modifications, equivalent replacements and improvements made within the spirit and principle of the present application are also deemed to fall into the scope of the present application defined by the claims.

What is claimed is:

1. An air vent structure, comprising a frame arranged at an air outlet or an air inlet of a box body of a box-type inverter, wherein the air vent structure further comprises a plurality of plates which are arranged in a direction parallel to each other, wherein:

a cross section of each of the plates is a bent structure, each of the plates comprises a first flat portion, an upslope portion and a downslope portion, and wherein the first flat portion of each of the plates is fixed to the frame and extends in a direction away from the frame, the plate then extending upward to form the upslope portion, and wherein a top of the upslope portion bends downward to form the downslope portion, and wherein a height of the downslope portion is smaller than a height of the upslope portion, wherein each of the plates further comprises a second flat portion between the upslope portion and the downslope portion and parallel to the first flat portion.

2. The air vent structure according to claim 1, wherein each of the plates further comprises a third flat portion parallel to the first flat portion and connected to the downslope portion.

3. The air vent structure according to claim 2, wherein in a pair of adjacent plates, a perpendicular distance between the second flat portion of the lower plate and the first flat portion of the upper plate is smaller than the perpendicular distance between the third flat portion and the first flat portion of a same plate of the pair.

4. The air vent structure according to claim 3, wherein a perpendicular distance between the two plates of the pair is larger than the perpendicular distance between the third flat portion and the first flat portion of each of the plates.

5. The air vent structure according to claim 1, wherein each of the plates is an integrally molded structure.

6. The air vent structure according to claim 1, wherein each of the plates is formed by bending a stamping part.

7. The air vent structure according to claim 1, wherein one side of the air vent structure is mounted with a self-hanging louver through a linkage.

8. The air vent structure according to claim 1, wherein one side of the air vent structure is mounted with a screen mesh.

9. A box-type inverter, wherein the air inlet or the air outlet of the box-type inverter is mounted with the air vent structure according to claim 1.

10. A box-type inverter, wherein the air inlet or the air outlet of the box-type inverter is mounted with the air vent structure according to claim 3.

11. A box-type inverter, wherein the air inlet or the air outlet of the box-type inverter is mounted with the air vent structure according to claim 5.

12. A box-type inverter, wherein the air inlet or the air outlet of the box-type inverter is mounted with the air vent structure according to claim 6.

13. A box-type inverter, wherein the air inlet or the air outlet of the box-type inverter is mounted with the air vent structure according to claim 7.

14. A box-type inverter, wherein the air inlet or the air outlet of the box-type inverter is mounted with the air vent structure according to claim 8.

* * * * *